US005399378A

United States Patent [19]

Uemura et al.

[11] Patent Number: 5,399,378

[45] Date of Patent: Mar. 21, 1995

[54] PROCESS OF MANUFACTURING CARBON FIBERS WITH HIGH CHEMICAL STABILITY

[75] Inventors: Seiichi Uemura, Tokyo; Yoshio Sohda, Machida; Takefumi Kohno, Yokohama, all of Japan

[73] Assignee: Nippon Oil Co., Ltd., Japan

[21] Appl. No.: 556,972

[22] Filed: Jul. 13, 1990

[30] Foreign Application Priority Data

Jul. 17, 1989 [JP] Japan ..... 1-184110

[51] Int. Cl.[6] ..... C01B 31/30

[52] U.S. Cl. ..... 427/228; 423/447.7; 423/460

[58] Field of Search ..... 423/460, 440, 447.5, 423/447.7; 427/228; 428/389

[56] References Cited

U.S. PATENT DOCUMENTS

| | | | |
|---|---|---|---|
| 3,356,525 | 12/1967 | Gutzeit | 427/228 |
| 3,785,944 | 1/1974 | Bowman et al. | 423/440 |
| 4,162,301 | 7/1979 | Homling | 423/447.5 |
| 4,424,145 | 1/1984 | Sara | 423/460 |
| 4,826,666 | 5/1989 | Lame | 427/440 |

FOREIGN PATENT DOCUMENTS

| | | | |
|---|---|---|---|
| 55-3346 | 1/1980 | Japan | 423/460 |
| 63-105115 | 5/1988 | Japan | 423/440 |

*Primary Examiner*—Michael Lewis
*Assistant Examiner*—Stuart L. Hendrickson
*Attorney, Agent, or Firm*—Adams & Wilks

[57] ABSTRACT

A process of manufacturing carbon fibers of high chemical stability comprises reacting feed carbon fibers having an elastic modulus of $30\times10^3$ kgf/mm$^2$ with a compound of elements capable of forming a carbide ceramics on the carbon fibers peripherally alone or both peripherally and partially internally.

11 Claims, No Drawings

PROCESS OF MANUFACTURING CARBON FIBERS WITH HIGH CHEMICAL STABILITY

BACKGROUND OF THE INVENTION

1. Field of the Invention

This invention relates to a process of manufacturing carbon fibers having increased chemical stability.

2. Prior Art

Ceramic fibers have potential application for fiber-reinforced metal composite material known as FRM or MMC and carbon fiber reinforced ceramics composite material known as CFRCe. These ceramic fibers are not sufficiently resistant to heat, and they are produced for instance by chemical vapor deposition in which silicon carbide is coated over carbon fibers. This method is however disadvantageous in that the resulting coated fiber product is objectionably thick and extremely costly.

Another method is disclosed in Japanese Patent Publication No. 50-29528 in which carbon fiber is heated at least at 800° C. in a gaseous atmosphere containing silicon components so as to provide a silicon carbon region at the outer surface as well as at least part of the inner layer of the fiber.

There is still another method of producing ceramics-coated carbon fiber as disclosed in Japanese Laid-Open Publication No. 63-211368, in which a flock of continuous carbon filaments is coated with a heat-resistant carbide by means of reactive chemical deposition.

The carbon fibers produced by any of the above known methods are not sufficiently resistant to heat and chemicals as they are and hence not suitable for use as satisfactory fiber reinforced metal composite material or fiber-reinforced ceramics composite material.

SUMMARY OF THE INVENTION

With the foregoing difficulties of the prior art in view, the present invention seeks to provide a novel process of manufacturing carbon fibers which are highly resistant to oxidation, heat and reaction with matrix.

According to the invention, there is provided a process of manufacturing carbon fibers of high chemical stability which comprises reacting starting carbon fibers at 800° C.–1,700° C. and at 0.1–760 mmHg with a compound capable of forming a heat-resistant carbide ceramics on the carbon fibers, the compound being selected from the group consisting of halides, hydrides and organometallic compounds of Si, Zr, Ti, Hf, B, Nb and W, so as to form a carbide ceramic at the surface portion alone of the carbon fibers or together with part of an inner layer of the fibers, and thermally treating the carbon fibers in an inert gas atmosphere at 1,000° C.–3,000° C.

DETAILED DESCRIPTION OF THE INVENTION

Carbon fiber suitable for use according to the invention is a pitch-based or polyacrylnitrile-based fiber having high elastic modulie of $30\times10^3$ kgf/mm$^2$ or above, preferably above $40\times10^3$ kgf/mm$^2$, more preferably in the range of from $50\times10^3$ kgf/mm$^2$ to $100\times10^3$ kgf/mm$^2$. Pitch-based carbon fiber has been found particularly suitable for the purpose of the invention.

In the practice of the invention, the carbon fiber may be used in the form of a bundle of filaments numbering in the range of 500–25,000. Alternatively, it may be used as a two-dimensional or three-dimentional product such as laminates of unidirectional products, two-dimensional fabric or its laminates, three-dimentional fabric, mat, felt and the like.

The process of the invention involves heating a starting carbon fiber and contacting the same with a compound capable of forming a heat-resistant carbide so as to make a carbide ceramic layer at the fiber surface portion alone or together with part of the fiber inner layer.

The term heat-resistant carbide as used herein includes SiC, ZrC, TiC, HfC, $B_4C$, NbC and WC, of which SiC, ZrC, TiC and HfC are preferred.

The term compound capable of forming a heat-resistant carbide includes halides, hydrides and organometallic compounds of Si, Zr, Ti, Hf, B, Nb and W such as for example $SiCl_4$, $SiH_4$, $ZrCl_4$, $TiCl_4$ and $HfCl_4$. These compounds are reacted normally in gaseous phase with carbon fiber.

The carbide forming reaction is carried out preferably in the presence of hydrogen, the amount of which depends upon reaction temperature, gas feed rate, fiber quantities, type of furnace and other parameters. Hydrogen is added usually in an amount less than five times, preferably 0.1–5 times the amount of the carbide forming compound. The reaction is effected at atmospheric or in vacuum normally at 0.1–760 mmHg, preferably 10–760 mmHg, more preferably 50–760 mmHg and with or without addition of an inert gas such as $N_2$, $NH_3$, Ar, He, Ne, Kr, Xe and Rn for dilution of the reaction mixture.

The carbide forming reaction temperature is 800° C.–1,700° C., preferably 1,000° C.–1,500° C. Lower temperatures than 800° C. would fail to give a carbide fiber with adequate thickness, while higher temperatures than 1,700° C. would result in a carbide film lacking uniformity and fine texture. The manner of heating the carbon fiber is not particularly restricted. It may be heated by joule's effect, or with induction current or otherwise heated externally. The reaction time is normally from one minute to ten hours. The thickness of the carbide film is normally 2.0 μm or less, preferably 1.0 μm or less, more preferably 0.01–0.6 μm, most preferably 0.01–0.3 μm, in which instance its weight increases should be held to 15% or less, preferably 10% or less, more preferably 5% or less.

The fiber is then subjected to heat treatment in an inert gas atmosphere at 1,000° C.–3,000° C., preferably 1,200° C.–1,800° C. and desirably at a temperature more than 50° C. higher than the carbide forming temperature, and for a time length of one minute to ten hours. This heat treatment is effected in vacuum above $10^{-3}$ mmHg and below 760 mmHg, preferably 0.1–500 mmHg and in an atmosphere containing an inert gas such as $N_2$, $NH_3$, Ar, He, Ne, Kr, Xe and Rn.

The invention will be further described by way of the following examples, to which however the invention is not limited.

EXAMPLE 1

Pitch-based carbon fibers measuring 9.4 μm in diameter and having an elastic modulus of $40\times10^3$ kgf/mm$^2$ were placed in a reactor and heated at 1,350° C., followed by addition of $SiCl_4$ at 133 ml/min and $H_2$ at 500 ml/min. Reaction was continued for 60 minutes at a total pressure of 50 mmHg, until a SiC film was formed on the surface of the carbon fiber, in which instance no appreciable increases were found in the fiber diameter. The SiC coated fibers were then thermally treated in nitrogen atmosphere at 1,350° C., 1,700° C. and 2,000° C., respectively. Oxidation-resistance test was made by heating the coated fibers at 600° C. in the air for two consecutive hours. A similar test was made on one control (A) consisting of starting carbon fibers alone and another control (B) consisting of carbon fibers coated with SiC but not thermally treated. The results of these tests are shown in Table 1.

TABLE 1

| | control (A) | control (B) (without heat treatment) | Inventive SiC coated fibers treatment temperature 1350° C. | 1700° C. | 2000° C. |
|---|---|---|---|---|---|
| fiber diameter (μm) | 9.4 | 9.4 | 9.4 | 9.4 | 9.4 |
| elastic modulus ($10^3$ kgf/mm$^2$) | 40 | 43 | 41 | 42 | 47 |
| tensile strength (kgf/mm$^2$) | 330 | 328 | 324 | 336 | 382 |
| oxidation-resistance (weight loss %) | 58 | 21 | 12 | 11 | 11 |

The above test data are clearly indicative of superiority of the SiC coated carbon fibers produced according to the invention in terms of oxidation-resistance and strength properties.

EXAMPLE 2

Polyacrylnitrile-based carbon fibers measuring 7.3 μm in diameter and having an elastic modulus of $21\times10^3$ kgf/mm$^2$ were placed in a reactor and heated at 1,400° C., followed by addition of $SiCl_4$ at 133 ml/min and $H_2$ at 500 ml/min. Reaction was continued for 60 minutes at a total pressure of 50 mmHg, until a SiC film was formed on the surface of the carbon fiber, in which instance no appreciable increases were found in the fiber diameter. The SiC coated fibers were then thermally treated in nitrogen atmosphere at 1,700° C.

The procedure of Example 1 was followed for oxidation-resistance tests, with the results shown in Table 2.

TABLE 2

| | control (A) | control (B) (without heat treatment) | Inventive SiC coated fiber treatment temperature (1700° C.) |
|---|---|---|---|
| fiber diameter (μm) | 7.3 | 7.3 | 7.3 |
| elastic modulus ($10^3$ kgf/mm$^2$) | 22 | 24 | 26 |
| tensile strength (kgf/mm$^2$) | 270 | 300 | 166 |
| oxidation-resistance (weight loss %) | 100 | 95 | 13.6 |

The above test data are clearly indicative of superiority of the SiC coated carbon fibers produced according to the invention in terms of oxidation-resistance and strength properties.

EXAMPLE 3

Pitch-based carbon fibers measuring 9.4 μm in diameter and having an elastic modulus of $40\times10^3$ kgf/mm$^2$ were placed in a reactor and heated at 1,300° C., followed by addition of $SiCl_4$ at 133 ml/min and $H_2$ at 33 ml/min. Reaction was continued for 10 minutes at a total pressure of 500 mmHg, until a SiC film was formed on the surface of the carbon fiber, in which instance no appreciable increases were found in the fiber diameter. The SiC coated fibers were then thermally treated in nitrogen atmosphere at 1,700° C. Oxidation-resistance test was made by heating the coated fibers at 600° C. in the air for two consecutive hours. A similar test was made on one control (A) consisting of starting carbon fibers alone and another control (B) consisting of carbon fibers coated with SiC but not thermally treated. The results of these tests are shown in Table 3.

TABLE 3

| | control (A) | control (B) (without heat treatment) | Inventive SiC coated fibers treatment temperature (1700° C.) |
|---|---|---|---|
| fiber diameter (μm) | 9.4 | 9.4 | 9.4 |
| elastic modulus ($10^3$ kgf/mm$^2$) | 40 | 40 | 44 |
| tensile strength (kgf/mm$^2$) | 330 | 330 | 340 |
| oxidation-resistance (weight loss %) | 58 | 20 | 10 |

The of above test data are clearly indicative of the superiority of the SiC coated carbon fibers produced according to the invention in terms of oxidation-resistance and strength properties.

What is claimed is:

1. A process of manufacturing carbon fibers of high chemical stability which comprises reacting starting carbon fibers with a compound capable of forming a heat-resistant carbide ceramic on said carbon fibers, said compound being selected from the group consisting of silicon halide, zirconium halide, titanium halide, hafnium halide, boron halide, niobium halide, tungsten halide, silicon hydride, zirconium hydride, titanium hydride, hafnium hydride, boron hydride, niobium hydride and tungsten hydride, the carbide forming reaction being effected at 800° C.–1,700° C., at 0.1–760 mmHg and in the presence of hydrogen in an amount of 0.1–5 times the amount of said compound, so as to form a carbide ceramic at the surface portion alone of said carbon fibers or together with part of an inner layer of said carbon fibers, and thereafter thermally treating said carbon fibers at 1,000° C.–3,000° C. in a gas atmosphere selected from the group consisting of $N_2$, $NH_3$, He, Ne, Ar, Kr, Xe and Rn.

2. A process according to claim 1, wherein the thermal treatment is carried out at a temperature which is at least 50° C. higher than the temperature at which the carbide is formed.

3. A process according to claim 1, wherein said starting carbon fibers are pitch-based carbon fibers.

4. A process according to claim 3, wherein said carbon fibers have an elastic modulus of above $30\times10^3$ kgf/mm$^2$.

5. A process according to claim 1, wherein said carbon fibers have an elastic modulus of above $30\times10^3$ kgf/mm$^2$.

6. A process of manufacturing carbon fibers of high chemical stability, comprising: reacting starting carbon fibers with a compound capable of forming a heat-resistant carbide ceramic on said carbon fibers, said compound being selected from the group consisting of silicon halide, zirconium halide, titanium halide, hafnium halide, boron halide, niobium halide, tungsten halide, silicon hydride, zirconium hydride, titanium hydride, hafnium hydride, boron hydride, niobium hydride and tungsten hydride, the carbide forming reaction being effected at 800° C.–1,700° C., at 0.1–760 mmHg and in the presence of hydrogen in an amount of 0.1–5 times the amount of said compound, so as to form a carbide ceramic layer on at least the surface portion of said carbon fibers, and thereafter thermally treating said carbon fibers at 1,000° C.–3,000° C. in a gas atmosphere selected from the group consisting of $N_2$, $NH_3$, He, Ne, Ar, Kr, Xe and Rn.

7. A process according to claim 6, wherein the thermal treatment is carried out at a temperature which is at least 50° C. higher than the temperature at which the carbide is formed.

8. A process according to claim 6, wherein said starting carbon fibers are pitch-based carbon fibers.

9. A process according to claim 6, wherein said carbon fibers have an elastic modulus of above $30\times10^3$ kgf/mm$^2$.

10. A process according to claim 6, wherein the thermal treatment is carried out at 1,200° C. to 1,800° C.

11. A process according to claim 6, wherein the carbon fibers have an elastic modulus of $40\times10^3$ to $100\times10^3$ Kgf/mm$^2$.

* * * * *